US006731894B2

(12) United States Patent
Liu

(10) Patent No.: US 6,731,894 B2
(45) Date of Patent: May 4, 2004

(54) PROTECTIVE SHUTTER FOR AN ELECTROPHOTOGRAPHIC APPARATUS HAVING A REPLACEABLE DEVELOPER CARTRIDGE

(75) Inventor: Dean Liu, West Hills, CA (US)

(73) Assignee: Aetas Technology Inc., Irvine, CA (US)

( * ) Notice: Subject to any disclaimer, the term of this patent is extended or adjusted under 35 U.S.C. 154(b) by 0 days.

(21) Appl. No.: 10/150,659

(22) Filed: May 17, 2002

(65) Prior Publication Data

US 2003/0215262 A1 Nov. 20, 2003

(51) Int. Cl.[7] ..... G03G 15/08
(52) U.S. Cl. ..... 399/119
(58) Field of Search ..... 399/119, 222, 399/114, 110, 111, 107, 411, 120; 347/138, 152

(56) References Cited

U.S. PATENT DOCUMENTS 4,905,028 A * 2/1990 Okubo et al. ..... 347/138
5,053,820 A * 10/1991 Preszler et al. ..... 399/119
5,288,192 A * 2/1994 Ito et al. ..... 412/13
5,313,257 A * 5/1994 Kashima et al. ..... 399/393
5,379,092 A * 1/1995 Takashima ..... 399/119
6,374,067 B1 * 4/2002 Park ..... 399/107
6,400,917 B2 * 6/2002 Nakazato et al. ..... 399/111

FOREIGN PATENT DOCUMENTS

JP 11119494 A * 4/1999 ..... G03G/15/00
JP 2000196796 A * 7/2000 ..... G03G/21/16

* cited by examiner

*Primary Examiner*—Arthur T. Grimley
*Assistant Examiner*—Ryan Gleitz
(74) *Attorney, Agent, or Firm*—Orrick, Herrington & Sutcliffe LLP

(57) ABSTRACT

The present invention is directed to a shutter system for electrophotographic machines that effectively reduces the impact of ambient light on the photoreceptor, or image-bearing member. The shutter system of the present invention utilizes a shutter member that substantially covers the cartridge chamber when in a closed position. Preferably, the shutter member is disposed at the opening of the cartridge chamber. The shutter member is held in place by one or more support brackets and is biased to the closed position by one or more springs.

11 Claims, 3 Drawing Sheets

PROTECTIVE SHUTTER FOR AN ELECTROPHOTOGRAPHIC APPARATUS HAVING A REPLACEABLE DEVELOPER CARTRIDGE

FIELD OF THE INVENTION

The present invention relates generally to electrophotography, more particularly, to an improved design for the housing of a printer or copier that uses replaceable cartridges comprising an integral shutter apparatus for preventing ambient light from contacting the photoreceptor.

BACKGROUND OF THE INVENTION

Electrophotographic imaging process (or xerography) is a well-known method of copying or otherwise printing documents. In general, electrophotographic imaging uses a charge-retentive, photosensitive surface (known as a photoreceptor) that is initially charged uniformly. The photoreceptor is most typically in the form of a photosensitive drum or a photosensitive belt. The surface of the photoreceptor is then exposed to a light image representation of a desired image that discharges specific areas of the photoreceptor surface creating a latent image. Toner powder is applied by using a developing system, which carries the toner from a toner container to the photoreceptor surface at selected portions defining the latent image, thereby forming a developed image. This developed image is then transferred from the photoreceptor to a substrate (e.g. paper, transparency, and the like) and the printed copy is produced in a finishing step that fixes the toner to the substrate resulting in the final image. The final image quality is a reflection of the precision and reproducibility of the physical parameters required to create an image on the photoreceptor, the transfer of toner to the image formed on the photoreceptor, and the subsequent transfer of toner from the image-defined areas of the photoreceptor to a substrate. Therefore, the integrity of the photoreceptor surface is a critical feature for all electrophotographic apparatus.

A color or "tone-on-tone" electrophotographic imaging process is typically achieved by repeating the same process described above for each color or tone of toner desired thereby serially applying latent color images to the photoreceptor until all desired colors or tones are achieved and then transferring the color image to a substrate. Due to the requirement to sequentially apply latent images for each individual color, the tolerances for the toner transfer processes in a color apparatus are significantly more exacting than in a black and white printing apparatus, and the requirements for image quality are substantially more demanding. Therefore, for color printing apparatus, the integrity of the photoreceptor is an even more critical parameter in producing a high quality image.

For both color and monochrome printing apparatus, the toner is supplied in a replaceable developer cartridge that is purchased separately by the user and may be easily replaced when the toner is completely used. To replace a developer cartridge, the user manually removes the old cartridge from the printer/copier and then inserts a new cartridge. Because the developer cartridge contains the toner that must be transferred to the photoreceptor, and therefore must be stored in very close physical proximity to the photoreceptor, the process of replacing a developer cartridge necessarily exposes the photoreceptor to the external atmosphere during the period of time in which the used developer cartridge is removed and prior to the point at which the new developer cartridge is inserted. In current systems, ambient light may enter the interior of the housing of the apparatus, and specifically enter into the chamber that contains the cartridge, and contact the photoreceptor when a cartridge is not present in the cartridge chamber. Similarly, if a depleted toner cartridge is removed and not immediately replaced with a new cartridge, the photoreceptor will be continually exposed to ambient light during the entire period of time in which a developer cartridge is not in place. When exposed to ambient light, the photoreceptor becomes deteriorated, and with repeated or prolonged exposure to ambient light, the integrity of the photoreceptor will be comprised. Under such conditions, the capability of the photoreceptor to receive toner to create the latent image, and the subsequent transfer to substrate, will be less precise and the quality of the image will be reduced. Therefore, a need exists for an improved design for an electrophotographic apparatus that avoids deterioration of the photoreceptor from exposure to ambient light and that preserves the quality of the images produced by the photoreceptor.

SUMMARY OF THE INVENTION

The present invention provides a shutter or cover for the cartridge chamber that acts as an effective closure of the portion of the housing of the apparatus through which replacement developer cartridges are introduced to prevent ambient light from contacting the photoreceptor. The shutter is oriented to completely block ambient light from entering the interior of the housing of the apparatus and may be spring loaded to automatically move into place when a developer cartridge is removed. When a developer cartridge is in place, the shutter rotates into an orientation that does not impede the function or placement of the developer cartridge, but the shutter remains in position for blocking ambient light when the developer cartridge is removed. Preferably, the shutter rotates around a tensioned hinge that biases the shutter into a closed position to substantially block all ambient light from entering the housing of the apparatus.

Other aspects and features of the present invention will become apparent from consideration of the following description taken in conjunction with the accompanying drawings.

DETAILED DESCRIPTION OF THE PREFERRED EMBODIMENTS

Figure 1:
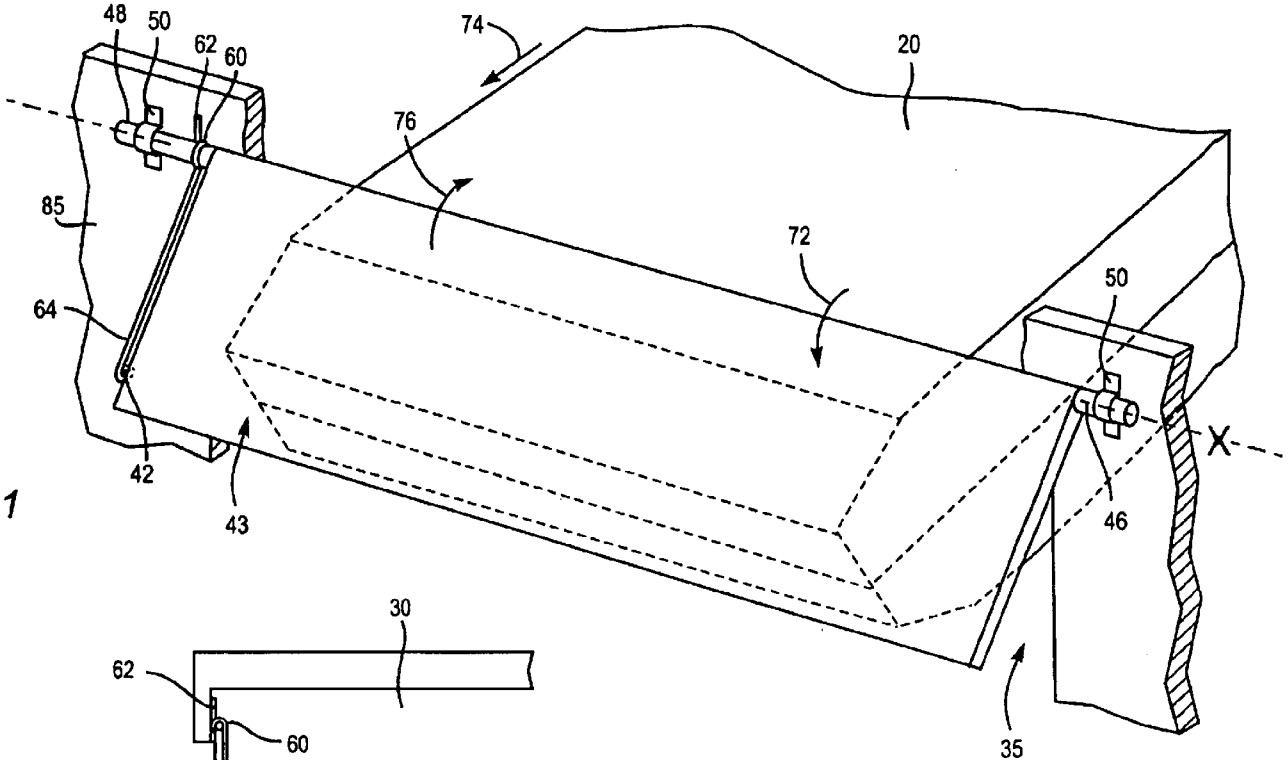
FIG. 1 is the shutter system of the invention shown oriented relative to the interior of the cartridge chamber where a developer cartridge is partially entering the cartridge chamber.

Referring generally to the Figures, a photoreceptor 10 is generally used as an image-bearing member in electrophotographic apparatus such as a photocopier or a laser printer and may be in the form of a photosensitive drum or a belt. The photoreceptor 10 is entirely contained within the housing of an electrophotographic apparatus that typically contains a receptacle for substrate, such as paper and provides a structure for the electric motor and other components of the apparatus. The housing of the apparatus also defines the cartridge chambers 30 and openings 35 therein such that developer cartridges 20 can be inserted and removed as necessary. As noted above, the portions of the developer cartridge 20 containing toner are oriented within the housing of the apparatus to be in close proximity to the photoreceptor 10 so that the photoreceptor can receive toner to create a latent image that is transferred to substrate. The photoreceptor 10 is constructed of a material that is conductive (i.e. allows a charge to dissipate) only when exposed to light. The photoreceptor 10 may comprise a photosensitive layer of zinc oxide or an organic semiconductor. Exposure of the photosensitive layer to external, ambient light results in deterioration of the photosensitive layer and reduction of image quality.

A developer cartridge 20 may comprise a developing roller, a toner feeding member, and a toner storage portion. The developer cartridge 20 is housed in a cartridge chamber 30 after being inserted through a cartridge insertion port or other opening 35 in the housing of the apparatus. The toner feeding member moves toner from the toner storage portion to the photoreceptor 10 during operation of the electrophotographic apparatus. A black and white printing system may use one or more developer cartridges 20. A color printing system may use from three to six developer cartridges 20. In a three cartridge system, generally three color cartridges are used (yellow, magenta, and cyan). In a four cartridge system, generally three color cartridges are used (yellow, magenta, and cyan) and a black cartridge is used. The one or more developer cartridges 20 are advantageously disposed around the photoreceptor 10 to facilitate the transfer of toner. As is known in the art, in order to create the desired electrostatic latent image on the photoreceptor 10, the developing roller attached to a developer cartridge 20 is positioned to face the photoreceptor 10. The latent image is then developed into a toner image and the toner image is then transferred onto the recording material (e.g. paper or a transparency). As noted previously, many printers or copiers are designed so that the developer cartridge 20 can be readily replaced by the user when the supply of toner is exhausted. Thus, the design requires that the developer cartridge 20 be capable of both delivering toner to the photoreceptor 10, while simultaneously being accessible to the user for easy replacement. In one embodiment, the developer cartridge 20 has two distinct structures comprising a portion designed to facilitate toner transfer, and a portion that is accessible to the user that may be grasped by hand and removed from the housing of the apparatus during the replacement procedure. The developer cartridge 20, when placed in position for use, may be completely contained within the housing of the apparatus such that the shutter is closed when the developer cartridge 20 is in place for normal operation. Also, the developer cartridge 20 may only partially traverse a portion of the housing apparatus such that a portion of the developer cartridge 20 is retained inside the cartridge chamber 30 and a portion thereof extends through an opening 35 to extend beyond the housing of the apparatus. In this latter embodiment, the shutter is positioned in the open position when the developer cartridge 20 is in place for ordinary use and only moves into the closed position when the developer cartridge 20 is removed in its entirety.

In use, when the supply of toner in a developer cartridge 20 has been exhausted, the user replaces the developer cartridge 20, which may require opening an exterior door (not shown) of the electrophotographic apparatus, or may be achieved by directly detaching the developer cartridge 20 from the housing. In either case, the developer cartridge 20 is typically inserted and removed through an opening 35 providing access to the cartridge chamber 30 (see FIGS. 1 and 2). In current systems, the removal of the developer cartridge 20 from the cartridge chamber 30 allows ambient light to enter the cartridge chamber 30 through the opening 35 to contact the photoreceptor 10.

Figure 2:
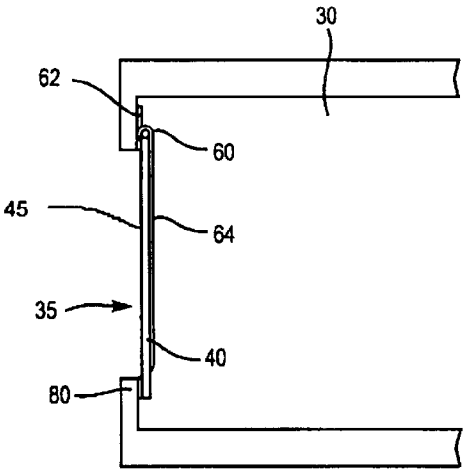
FIG. 2 is the side view of a shutter system of the present invention incorporated in a cartridge chamber and oriented in the closed position in the absence of a developer cartridge.

In the present invention, a shutter system is integrated into the housing of the apparatus and substantially covers the opening 35 in the cartridge chamber 30. As shown in FIG. 1, the shutter system is directly attached to a portion of the housing of the apparatus and is comprised of a shutter member 40, one or more support brackets 50, and one or more springs 60. The shutter member 40 may be comprised of a substantially planar shutter body 44 and two end portions 46, 48. Preferably, the end portions 46, 48 are rotatably positioned within the support brackets 50 to form a hinge structure that allows the shutter body 44 to rotate about the axis defined by the position of the end portions 46, 48 relative to the support brackets 50. The shutter body 44 may also be connected with a conventional hinge that runs the length of the axis at which the shutter member 40 is attached to the housing of the apparatus, and about which the shutter member 40 rotates between the open and closed positions. Where more than one shutter member 40 is provided to prevent ambient light from entering more than one cartridge chamber, the individual shutter body 44 of each shutter member 40 may share a common structure facilitating rotation into the open and closed position. For example, two shutter bodies 44 (not shown) may have a common hinge structure such that each rotates around a common axis, but are positioned in different directions and orientations to seal the openings of two cartridge chambers 30. In use, each shutter member 40 rotates to allow the developer cartridge 20 to be inserted into the cartridge chamber 30, but closes as the developer cartridge 20 is removed from the cartridge chamber 30. In a preferred embodiment, the shutter member 40 is disposed substantially adjacent to the opening 35 (see FIG. 3) in the cartridge chamber 30. The shutter member 40 may be comprised of a plastic resin, aluminum, other metal, or any substantially rigid material. The shutter body 44 may be substantially planar, as is illustrated in the Figures, or may be curved to accommodate the housing of the apparatus. In any shape, the perimeter of the shutter body 44 is designed and shaped to abut the entire perimeter of the opening 35 in the cartridge chamber 30 to substantially seal the cartridge chamber 30 from ambient light. The length and width of the body 44 of the shutter member 40 are preferably greater than the length and width of the opening 35 in order to cover the entire opening 35 and block all ambient light or dust from entering the cartridge chamber 30. However, the shape of the body 44 may be such that it covers the entire exterior portion of the opening 35, as is illustrated in FIG. 1, or may be positioned internally of the cartridge chamber 30 in which case the body 44 may be positioned to seal an interior portion of the opening 35, as is illustrated in FIG. 2. In either case, felt or other material may be added to the face 45 of the body 44 of the shutter member 40 that contacts the surface of the housing, such as a frame 80, that surrounds the opening 35 to reduce the impact of the shutter member 40 on the face 85 of the frame 80 as the shutter member 40 closes. The ends 46, 48 of the shutter member 40 are slightly spaced away from the body 44 to avoid interfering with a sealing engagement of the body 44 and the frame 80 to ensure a complete and intact seal about the perimeter of the opening 35. The ends 46, 48 are preferably cylindrical and are adapted to engage a spring 60 and/or a support bracket 50 preferably at both ends of the shutter body 44.

Figure 3:
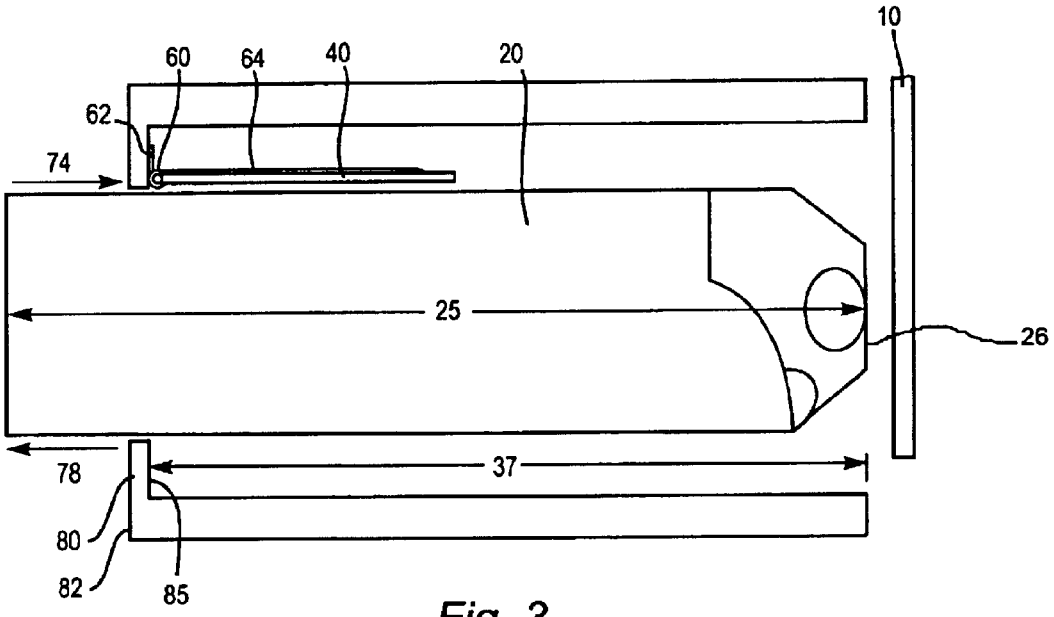
FIG. 3 is a cartridge chamber within the housing of an electrophotographic apparatus in which a developer cartridge is inserted and the shutter is placed at an exterior portion of the housing of the apparatus and where the shutter is oriented in an open position.
Figure 4:
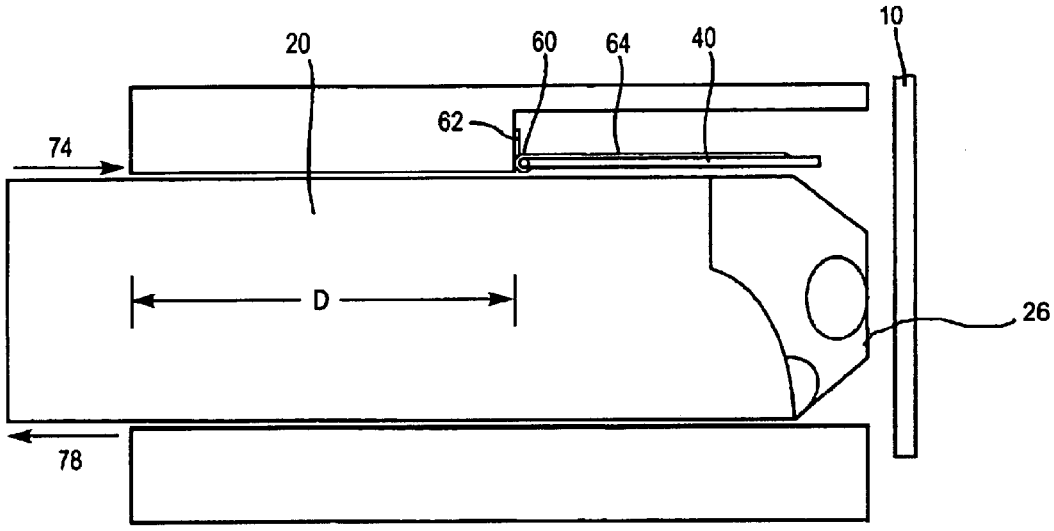
FIG. 4 is a cartridge chamber within the housing of an electrophotographic apparatus in which a developer cartridge is inserted and the shutter is placed at an internal position within the housing of the apparatus and within the cartridge chamber such that the shutter abuts the developer cartridge at an intermediate point when a cartridge is inserted. In this embodiment, the shutter closes only a portion of the cartridge chamber from ambient light while still being positioned to prevent ambient light from contacting the photoreceptor when the shutter is in the closed position.

The shutter member 40 is supported by at least one support bracket 50 and may be rotatably coupled with the support bracket 50. Referring to FIGS. 2–4, the support brackets 50 are preferably placed on the face 85 of the frame 80 of the electrophotographic apparatus. The support bracket 50 may be in the form of a closed loop or other similar structure that is configured for retaining the ends 46, 48 of the shutter member 40. The support bracket 50 may also be a hinge or other structure adapted to engage the body 44 of the shutter member 40. In a preferred embodiment, there are two support brackets 50, one near each end 46, 48 of the shutter member 40. The two support brackets 50 may be placed on opposite sides of the opening 35 of the cartridge chamber 30.

Figure 5:
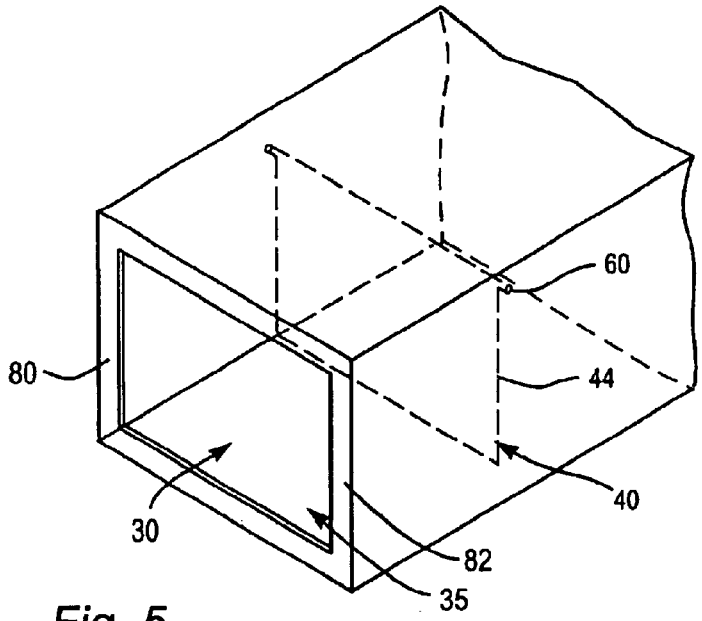
FIG. 5 is a fragmentary, perspective view of a cartridge chamber.

As shown in FIGS. 4 and 5, the shutter system also may be placed within the cartridge chamber 30 rather than being substantially disposed at the opening 35 of the cartridge chamber 30. In this embodiment, support brackets 50 would be located within recessed portions of the cartridge chamber 30 to support the shutter member 40. Support brackets 50 may be located on opposite sides of the cartridge chamber 30, or two support brackets 50 may be located on the same side of the cartridge chamber 30. In this embodiment, the developer cartridge 20 does not engage the front facing surface 45 of the shutter member 40 until the developer cartridge 20 has been inserted a distance D along the cartridge chamber 30.

A spring 60 may be fixedly coupled on the shutter member 40 near one of the ends 46, 48. In a further embodiment, the shutter system may comprise more than one spring 60. The spring 60 can be any kind of elastic or resilient member including but not limited to conventional torsional or linear springs. One end 62 of the spring 60 engages the interior face 85 of the frame 80. The opposite end 64 of the spring 60 contacts the body 44 of the shutter member 40. In a preferred embodiment, the body 44 of the shutter member 40 comprises a tab 42 extending from the interior facing surface 43 of the body 44 of the shutter member 40. The end 64 of the spring 60 may be looped around the tab 42 to ensure engagement of the spring 60 with the shutter member 40. The spring 60 provides a force against the shutter member 40 in a counterclockwise direction as shown by arrow 72, to bias the shutter member 40 to a closed position.

In another embodiment, the shutter member 40 includes a curved portion through which a shaft (not shown) passes. Support brackets 50 may support the ends of the shaft to comprise the hinge function described previously. In this embodiment, the shutter member 40 may be rotatable about the shaft independently of the rotation of the shaft. The shutter system may also include two or more overlapping shutter members 40. In this embodiment, the shutter members 40 would overlap to cover the cartridge chamber 30.

The shutter member 40 is capable of being in a closed position defined as the position in which the shutter member 40 engages the perimeter of the opening 35 to seal ambient light or an open position in which the developer cartridge 20 is typically in place and the opening 35 is not sealed. The shutter member 40 may be biased by the spring 60 towards an upward closed position, a downward closed position or a sideways closed position. In a preferred embodiment, the shutter member 40 is substantially axial to the plane of the cartridge chamber 30 when in the closed position and in substantially the same plane as the cartridge chamber 30 when in the open position. Hereinafter, the closed position will refer to a substantially vertical position and the open position will refer to a substantially horizontal position. As a developer cartridge 20 is inserted into the cartridge chamber 30, the shutter member 40 is forced to pivot about the axis X towards the open position. As the shutter member 40 moves toward the open position, tension in the spring 60 increases and the closing force generated by the spring 60 increases. Upon removal of the developer cartridge 20, the tension of the spring 60 restores the shutter member 40 to the closed position.

In one embodiment, the length 37 of the cartridge chamber 30 is shorter than the length 25 of the developer cartridge 20. Therefore, the developer cartridge 20 can be removed manually by the user in order to replace the developer cartridge 20. In this embodiment, the shutter member 40 remains in an open, substantially horizontal position while the developer cartridge 20 is inserted in the cartridge chamber 30. Upon removal of the developer cartridge 20, the spring 60 returns the shutter member 40 to the closed, substantially vertical position.

In another embodiment, the length 37 of the cartridge chamber 30 is greater than the length 25 of the developer cartridge 20. In this embodiment, complete insertion of the developer cartridge 20 may result in the shutter member 40 returning to the closed position. In order to remove the developer cartridge 20 in this embodiment, an ejection system (not shown) of any type known in the art may be utilized. For example, an ejection lever or button may be placed on the exterior face 82 of the frame 80. Upon moving the lever or depressing the button, the developer cartridge 20 may be grasped at the front end by a movable plate. The developer cartridge 20 may also contain one or more notches that are grasped by the ejection system to allow removal of the developer cartridge 20. Another portion of the ejection system may force the shutter member 40 to an open position to allow the developer cartridge 20 to slide out of the cartridge chamber 30.

As discussed above, in a color printer there may be three or more different cartridges used. For example, some printer systems include three color cartridges. Other systems have three color cartridges and one black cartridge. Generally, each developer cartridge 20 utilizes a separate cartridge chamber 30. Preferably, there will be one to six shutter systems corresponding to the number of cartridges utilized in the printing device. Therefore, a printer with four cartridges would have four shutter systems. One or more shutter systems may share support brackets 50.

Figure 6:
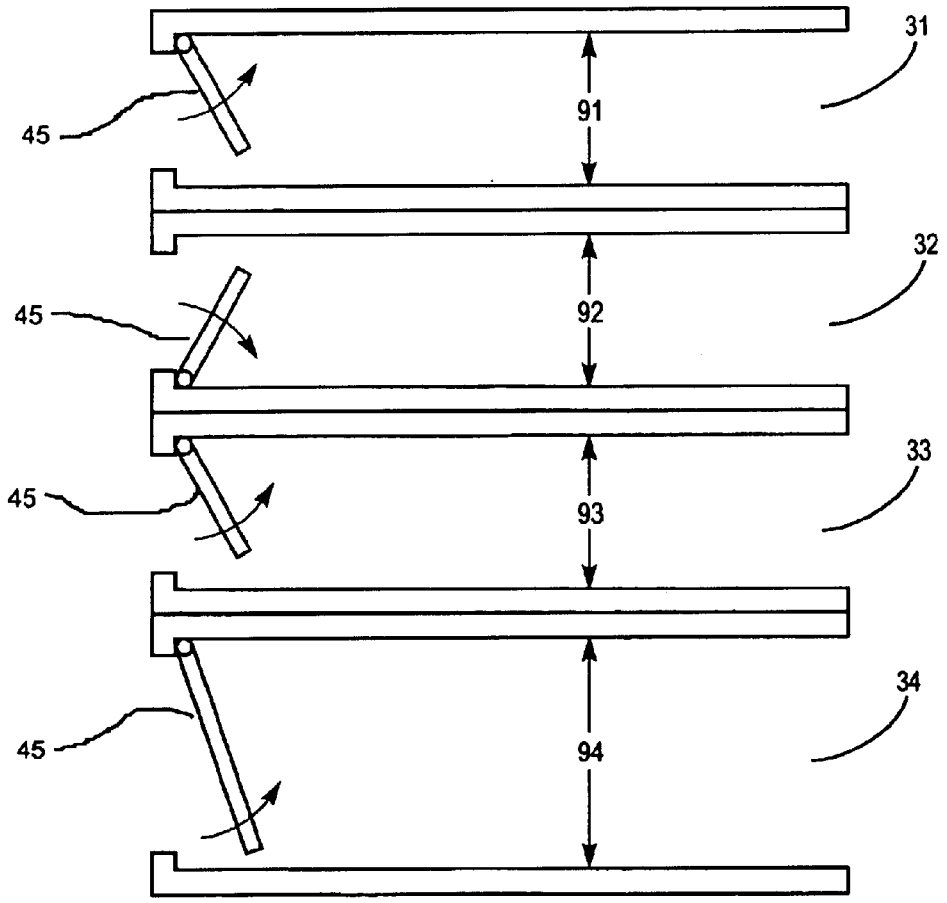
FIG. 6 is an exemplary four cartridge chamber system found in many color electrophotographic devices incorporating the present invention for each cartridge chamber.

An exemplary system with four cartridge chambers (31, 32, 33, 34) is shown in FIG. 6. For example, cartridge chambers 31, 32, 33 may be configured to receive developer cartridges 20 comprising yellow toner, magenta toner, and cyan toner, respectively. Cartridge chamber 34 may be configured to receive a developer cartridge 20 comprising black toner. As can be seen from this exemplary system, the shutter member 44 may rotate in different directions based on the positioning of the support brackets 50 and spring 60.

The size of the body 44 of the shutter member 40 may vary according to the size of the developer cartridge 20. As shown in FIG. 6, the height 94 of the black toner cartridge chamber 34 may be greater than the height 91, 92, 93 of the color cartridge chambers 31, 32, 33. Therefore, the length of the shutter member 40 for the black developer cartridge would be greater than the length of the shutter member 40 for the color developer cartridges. Thus, the invention includes an electrophotographic apparatus having one larger black toner cartridge chamber 34 and three identical or similarly sized cartridge chambers 31, 33, 34 for color toner.

In operation, before insertion of a developer cartridge 20, the shutter member 40 is in a closed position to cover the opening 35 of the cartridge chamber 20. Insertion of the developer cartridge 20 into the cartridge chamber 30 in the direction of arrow 74 causes the front end 26 of the developer cartridge 20 to engage the front facing surface 45 of the shutter member 40. Continued movement of the developer cartridge 20 into the cartridge chamber 30 forces the shutter member 40 to pivot about axis X as indicated by arrow 76. The shutter member 40 is therefore forced inwardly and upwardly creating tension on the spring 60. If the length 25 of the developer cartridge 20 is greater than the length 37 of the cartridge chamber 30, the shutter member 40 remains in the open position. If the user then removes the developer cartridge 20, the tension in the spring 60 will force the shutter member 40 to return to the closed position.

If the length 25 of the developer cartridge 20 is less than the length 37 of the cartridge chamber 30, the shutter member 40 may return to the closed position when a developer cartridge 20 is fully inserted in the cartridge chamber 30. In order to remove or replace the developer cartridge 20, the user may use a lever designed to engage the front end of the developer cartridge 20 and move the developer cartridge 20 in a direction marked by arrow 78 (see FIG. 1). In addition, the lever would also engage a second portion adapted to engage the closed shutter member 40 and move it to the open position.

Although the present invention has been discussed in relation to a color printer with multiple cartridges, the present invention can be utilized in other electrophotographic devices such as photocopiers, monochrome printers, and fax machines.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit and scope of the appended claims.

What is claimed is:

1. An image processing system, comprising:

an electrophotographic apparatus having a housing with at least one opening each being dimensioned to receive a developer cartridge and having an interior face;

a shutter member rotatably coupled with the interior face of the housing and being shaped to substantially cover the opening and contact the interior face when in a closed position;

means for rotating the shutter member between an open position and the closed position; and a spring adapted to bias the shutter member to the closed position.

2. The image processing system of claim 1, wherein the shutter member is coupled to the housing by at least one support bracket.

3. The image processing system of claim 2, wherein the shutter member further comprises at least one end portion engaging the at least one support bracket.

4. The image processing system of claim 1, wherein the rotating means comprises a hinge.

5. The image processing system of claim 1, wherein the electrophotographic apparatus comprises four openings.

6. The image processing system of claim 1, wherein the electrophotographic apparatus comprises six openings.

7. A method for covering an opening of a developer cartridge housing of an electrophotographic apparatus, comprising:

coupling a shutter member with an interior face of the developer cartridge housing, the shutter member being dimensioned to substantially cover the opening and contact the interior face when in a closed position;

disposing a rotating means on the shutter member, the rotating means being configured for rotating the shutter member between an open position and the closed position; and providing a spring adapted to bias the shutter member to the closed position.

8. The method of claim 7, wherein the shutter member comprises at least one end portion and further comprising engaging at least one end portion with a support bracket.

9. A protective shutter for an electrophotographic apparatus having a developer cartridge housing defining at least one opening each being dimensioned to receive a developer cartridge, comprising:

a shutter member being dimensioned to substantially cover the at least one opening of the developer cartridge housing and to contact an interior face of the housing when in a closed position;

a first end region being configured to engage a first portion of the developer cartridge housing;

a second end region being configured to engage a second portion of the developer cartridge housing; and a spring removably coupled with the shutter body and being configured to bias the shutter member to the closed position.

10. The protective shutter of claim 9, wherein the first end region and the second end region are configured to engage at least one support bracket.

11. The protective shutter of claim 9, further comprising a hinge coupled with the shutter member, the hinge being configured to rotate the shutter member between the closed position and an open position.

* * * * *